US012733751B2

(12) United States Patent
Mostafa et al.

(10) Patent No.: US 12,733,751 B2
(45) Date of Patent: Sep. 15, 2026

(54) CUSHIONS WITH VIRTUAL SURFACE CONTOURING

(71) Applicant: Purple Innovation, LLC, Lehi, UT (US)

(72) Inventors: Ahmed Jenan Mostafa, Lehi, UT (US); James T. Grutta, Draper, UT (US)

(73) Assignee: Purple Innovation, LLC, Lehi, UT (US)

( * ) Notice: Subject to any disclaimer, the term of this patent is extended or adjusted under 35 U.S.C. 154(b) by 166 days.

(21) Appl. No.: 18/425,779

(22) Filed: Jan. 29, 2024

(65) Prior Publication Data

US 2024/0251962 A1 Aug. 1, 2024

Related U.S. Application Data

(60) Provisional application No. 63/441,581, filed on Jan. 27, 2023.

(51) Int. Cl.
*A47C 27/14* (2006.01)

(52) U.S. Cl.
CPC ..... *A47C 27/144* (2013.01)

(58) Field of Classification Search
CPC ..... A47C 27/144; A47C 27/00; A47C 27/085; A47C 27/08; A47C 27/148; A47C 27/15; A61G 7/05723
See application file for complete search history.

(56) References Cited

U.S. PATENT DOCUMENTS

| | | | | |
|---|---|---|---|---|
| 2,588,823 | A * | 3/1952 | Glassman | A47C 27/15 5/655.9 |
| 6,898,814 | B2 * | 5/2005 | Kawamura | A47C 27/053 5/724 |
| 2005/0039264 | A1 * | 2/2005 | Barman | A47C 27/146 5/717 |
| 2005/0223667 | A1 | 10/2005 | Mccann et al. | |
| 2009/0246449 | A1 * | 10/2009 | Jusiak | A47C 27/085 428/99 |

(Continued)

OTHER PUBLICATIONS

USPTO acting as International Searching Authority, "International Search Report and Written Opinion," for International Application No. PCT/US2024/013359, May 16, 2024.

*Primary Examiner* — Matthew Troutman
*Assistant Examiner* — Alison N Labarge
(74) *Attorney, Agent, or Firm* — Foley & Lardner LLP

(57) ABSTRACT

A cushion with virtual contouring may have a uniform or substantially uniform thickness or height, while different locations or areas of the cushion may have different cushioning characteristics. The cushion may include a patterned grid defined by interconnected walls. The different cushioning characteristics may result from features that stiffen or soften hollow columns of the patterned grid, such as enlarged junctions between interconnected walls, voids in the interconnected walls, the thicknesses of the interconnected walls, the cross-sectional shapes and/or sizes of the hollow columns defined by the interconnected walls, the materials from which the interconnected walls are formed, layering of different patterned grids, or the like, or any combination of the foregoing. Methods for designing, manufacturing, and using cushions with virtual contouring are also disclosed.

16 Claims, 6 Drawing Sheets

(56) References Cited

U.S. PATENT DOCUMENTS

| | | | | |
|---|---|---|---|---|
| 2010/0146709 | A1 | 6/2010 | Lafleche et al. | |
| 2012/0233784 | A1* | 9/2012 | Wood | A47C 27/085 5/690 |
| 2020/0405082 | A1 | 12/2020 | Pearce et al. | |
| 2021/0059881 | A1* | 3/2021 | Raymond | A47C 27/15 |
| 2022/0400870 | A1* | 12/2022 | Micklos | B32B 3/12 |
| 2024/0023723 | A1 | 1/2024 | Mostafa | |

* cited by examiner

CUSHIONS WITH VIRTUAL SURFACE CONTOURING

CROSS-REFERENCE TO RELATED APPLICATION

A claim for priority to the Jan. 27, 2023 filing date of U.S. Provisional Patent Application No. 63/441,581, titled CUSHIONING ELEMENTS WITH VIRTUAL SURFACE CONTOURING ("the '581 Provisional Application"), is hereby made. The entire disclosure of the '581 Provisional Application is hereby incorporated herein.

TECHNICAL FIELD

This disclosure relates generally to cushions with different zones that cushion in different ways, including cushions with flat surfaces that have the feel of a contoured mattress (i.e., virtually contoured mattresses). Such virtual surface contouring may be accomplished in cushions in which a plurality walls are interconnected to define hollow columns by including one or more stiffeners and/or one or more voids in the walls that define the hollow columns of a particular area or zone of a cushioning surface to impart that area or zone of the cushioning surface with a desired cushioning characteristic. Methods for designing a cushion with interconnected walls that define hollow columns to impart the cushion with virtual surface contouring are also disclosed.

DISCLOSURE

A cushion of this disclosure includes a plurality of interconnected walls that define a plurality of cells, with the walls that define each cell comprising a hollow column. Walls of the plurality of interconnected walls may be formed from an elastomeric material, such as a so-called "gel." The walls may be arranged in such a way as to define a grid (e.g., a square grid, a rectangular grid, a triangular grid, a hexagonal grid, etc.), with the hollow columns defining the cells or spaces of the grid. Such an arrangement may be referred to as a "patterned gel layer." The hollow columns and the cells they define may be arranged in an array. For example, the walls may be arranged to create a square grid with each hollow column being substantially square. In some embodiments, the walls may be arranged to create a hexagonal grid with each hollow column being substantially hexagonal (i.e., a "honeycomb" arrangement). In some embodiments, the walls are arranged such that some regions of the cushion have a grid of one shape (e.g., square, hexagonal, triangular, diamond, etc.) and some regions have a grid of another shape (e.g., square, hexagonal, triangular, diamond, etc.).

The hollow columns and the cells they define may extend completely through a thickness of the cushion, substantially through the thickness of the cushion, or partially through the thickness of the cushion. A thin layer or film of a material (e.g., the material from which the interconnected walls are formed, etc.) may extend transversely across an end or an intermediate location of a hollow column and its cell that extend substantially through the thickness of the cushion. Such a thin layer or film may have a thickness that is about 5% or less of the thickness of the portion of the cushion through which the hollow column and its cell extend. A hollow column that extends partially through the cushion may include one section or a plurality of sections that, in combination, extend through less than 95% of the thickness of the portion of the cushion through which the hollow column and its cell extend.

The cushion may have a configuration that imparts it with virtual contouring. Stated another way, the cushion may have a flat surface with different areas or zones that have different cushioning characteristics or that support a cushioned object differently than other areas or zones of the cushioning surface.

The walls and/or hollow columns of each zone of such a cushion may include features that enable that zone of the cushion to have predetermined cushioning characteristics (e.g., stiffness (or firmness), deformability (e.g., the area of the surface of the cushion that deforms under a load, the extent (e.g., depth, etc.) to which the cushion deforms under the load, etc.), etc.) and, thus, to cushion an object (e.g., an individual, etc.) or a portion of the object in a predetermined manner. In this regard, the walls and/or hollow columns of a cushion according to this disclosure may have configurations (e.g., stiffeners, voids in the walls that define the hollow columns, etc.) that impart each zone of the cushion with a predetermined stiffness (i.e., softness and/or stiffness) and/or deformability.

The elastomeric material that forms the plurality of interconnected walls may comprise any suitable material that will readily deform when placed under a load and resiliently rebound (i.e., return to its original shape) upon removal of the load. In various embodiments, the elastomeric material may comprise a gel or a gel-like material. In a specific, but non-limiting example, the gel or gel-like material may comprise a block copolymer that has been extended with a plasticizer. A non-limiting example of a block copolymer is a triblock copolymer, such as a so-called A-B-A triblock copolymer. A nonlimiting example of a plasticizer is mineral oil. Other so-called "synthetic rubber" materials and other materials that may be used to form the walls include, without limitation, rubber, foams (e.g., polyurethane foams, etc.), and other materials that deform when placed under a load and resilient rebound (e.g., to their original shape, etc.) upon removing the load.

Optionally, adjacent zones of the cushion may be integrally formed, or formed during the same process step (e.g., molded together, etc.).

In some embodiments, one or more zones of the cushion may include stiffeners, or stiffeners. A stiffener, or stiffener, may be defined by the material (e.g., the elastomeric material, etc.) that defines the plurality of interconnected walls. Without limitation, a stiffener, or stiffener, may comprise an enlarged junction between interconnected walls at a corner of a hollow column, or cell, of the cushion. An enlarged junction may include one or more filleted (i.e., radiused) interior corners within the interior of a hollow column (i.e., a "filleted junction") or any other suitable enlarged shape (e.g., a round cross-section, such as a circle, oval, ellipse, etc.; a polygonal cross-section, such as a diamond, square, etc.); etc.). Each dimension across each end of such an enlarged junction (e.g., in-line with the interconnected walls, diagonals, etc.) may exceed a thickness of each wall of the walls joined at the enlarged junction.

An arrangement of stiffeners across a zone of the cushion may at least partially define cushioning characteristics of each zone of the cushion and provide different zones of the cushion with different cushioning characteristics at different locations, or areas or zones, over a cushioning surface of the cushion. As an example, locations of the cushioning surface that are intended to be relatively firm may include a firm arrangement of stiffeners (e.g., more stiffeners, larger stiffeners, etc.), while locations of the cushion that are intended to be relatively soft may include a soft arrangement of stiffeners (e.g., fewer stiffeners, smaller stiffeners, etc.).

A hollow column may include an enlarged junction (e.g., a filleted junction, etc.) at one corner. A hollow column may include enlarged junctions (e.g., filleted junctions, etc.) at a plurality of corners (e.g., opposite corners of the hollow column, etc.). Each corner of a hollow column may include an enlarged junction (e.g., a filleted junction, etc.) (i.e., all of the corners of the hollow column may include enlarged junctions).

All of the hollow columns of the cushion may include at least one stiffener. Alternatively, only selected hollow columns of the cushion (e.g., hollow columns at corners of the cushion, hollow columns at outer edges of the cushion, hollow columns at locations of the cushion that are expected to receive the greatest load (e.g., midway between the head and foot of a mattress etc.), etc.) may include at least one stiffener.

For example, each hollow column of the cushion of a mattress disposed in regions (i.e., zones) that correspond to locations where an individual will place their shoulders can include stiffeners in only selected (i.e., not all) hollow columns and/or fewer stiffeners in at least some hollow columns to make the shoulder areas of the cushion relatively soft. Similarly, regions (i.e., zones) of the cushion located where an individual would rest their hips can include stiffeners in only selected (i.e., not all) hollow columns and/or fewer stiffeners in at least some hollow columns to make the hip areas of the cushion relatively soft. Conversely, areas of the cushion that receive an individual's head, back, and legs may include stiffeners in more hollow columns and/or more stiffeners in at least some hollow columns to make these zones stiffer and, thus, firmer than the shoulder and hip zones of the cushion. The features of the walls of the buckling columns of the shoulder zone(s) and hip zone(s) may also be tailored to provide these zones with different stiffnesses or firmnesses. The features of the walls of the buckling columns of the head zone(s), back zone(s), and leg zone(s) may also be tailored to provide these zones with different stiffnesses and/or firmnesses.

In some embodiments, hollow columns including at least one stiffener are arranged throughout the cushion in a gradient, giving rise to regions of the cushion with greater stiffness or firmness and regions of the cushion with less stiffness or firmness.

Each hollow column of a cushion that includes at least one stiffener (e.g., one or more enlarged junctions, etc.) may be stiffened in the same manner (e.g., it may have the same number of enlarged junctions, etc.) as every other hollow column that includes at least one stiffener. As another option, the manner and extent to which each hollow column is stiffened (e.g., the type, number, and arrangement of stiffeners, such as enlarged junctions of the hollow column, etc.) may correspond to a location of the hollow column on the cushion. In some embodiments, the incorporation of stiffeners into a cushion with interconnected walls that define hollow columns may facilitate a reduction in the wall-to-wall distance or spacing (i.e., distance across each cell), height or thickness of the cushion.

In some embodiments, the cushion may include softeners. As a nonlimiting example, such a softener may comprise a void in at least one wall that defines at least one hollow column. Such a void may comprise a feature that excludes material from the plurality of interconnected walls. In some embodiments, the void may comprise an opening in a wall of the plurality of interconnected walls. Such an opening may include a recess, or a notch, in an edge of the wall. Such an opening may include a window in the wall. In other embodiments, a void may comprise a recess, or thinned region (e.g., a dimple, etc.) in one or both surfaces of the wall. Each void may have a size and shape that enables it to eliminate material from the wall, thereby reducing the weight of the wall and the weight and density of the cushion of which the wall is a part, without reducing the cushioning characteristics of the cushion. In some embodiments, the incorporation of voids into the walls of a cushion with interconnected walls that define hollow columns may facilitate a minimization in the wall-to-wall distance or spacing (i.e., distance across each cell) and/or the height or thickness of the cushion, or a reduction in the wall-to-wall distance or spacing and/or the height or thickness of the cushion relative to a conventional cushion that comprises a plurality of interconnected walls formed from an elastomeric material and defining a grid.

Variations in voids from one hollow column to another or from one region of a cushion to another may be employed in a manner that imparts a cushioning surface of the cushion with one or more gradients in stiffness and/or deformability. Such a gradient may be provided across a length and/or a width of the cushion, provide a transition between zones that have stiffnesses and/or deformabilities that differ from each other, or for any other purpose.

In some embodiments, the incorporation of voids into the interconnected walls that define hollow columns of a cushion may facilitate an increase in breathability of the cushion. Conventional cushions constructed from elastomeric materials generally do not permit air to flow through the elastomeric material and, thus, laterally through the cushion. This blocked air flow can trap heat, such as body heat, within the hollow columns of the cushion. By including voids within the walls, air and heat can pass laterally through at least portions of the cushion to unblocked hollow columns and/or a periphery of the cushion. Thus, the air and heat can pass more readily out of the cushion, creating a cooler and more comfortable experience for the user.

An arrangement of voids or other softeners in the walls across the cushion may at least partially define one or more cushioning characteristics of the cushion at different locations or regions over a cushioning surface thereof. As an example, voids or other softeners may be arranged evenly across the cushion to impart the cushion with the same cushioning characteristics across an entirety of the cushioning surface or substantially across the cushioning surface (e.g., with the possible exception of edges of the cushion, etc.). As another example, locations of the cushioning surface that are intended to be relatively firm may include a firm arrangement of voids (e.g., fewer voids, smaller voids, differently shaped voids (i.e., void geometry), etc.) or other softeners, while locations of the cushion that are intended to be relatively soft may include a soft arrangement of voids (e.g., more voids, larger voids, differently shaped voids (i.e., void geometry) etc.) or other softeners. Locations of the cushion that are intended to be relatively soft may correspond to a head, shoulder, and/or hip area of a user. Locations of the cushion that are intended to be relatively firm may correspond to a neck, back, leg, and/or arm area of a user.

In some embodiments, the particular stiffness and/or deformability of a particular zone of a cushion may be achieved by providing an elastomeric gel layer, or a patterned gel layer, with a hollow column geometry (e.g., shape, size, wall thickness, etc.) that provides the desired stiffness and deformability in that zone. By way of example, the stiffness and/or deformability of a patterned gel layer with interconnected walls that define cuboid cells may differ from the stiffness/softness and/or deformability of a patterned gel layer in which the interconnected walls define hollow columns with similarly sized hexagonal or triangular cross-sections taken transverse to the heights of the hollow columns, or to the height or thickness of the patterned gel layer. As another example, a patterned gel layer with interconnected walls that define cells of a particular shape (e.g., cuboid, hexagonal prisms, triangular prisms, etc.) having a relatively large size may be less stiff (i.e., softer) and/or more deformable than a patterned gel layer with interconnected walls that define cross-sectionally smaller cells of the same shape. Thus, patterned gel layers with different geometries may be included in different zones of a cushion to impart the different zones with stiffnesses and/or deformabilities that differ from each other.

Variabilty in stiffness and/or deformability from one zone of a cushion to another zone of a cushion may also be accomplished by using elastomeric gel materials that have different hardnesses (or softnesses) to define different zones of the cushion.

Differences in stiffness and/or deformability from one zone of a cushion to another may also be achieved by layering. For example, one or more zones of a cushion may include a single patterned gel layer. One or more other zones of the cushion may include two or more superimposed layers, the interconnected walls and cells of which are at least partially offset from each other. The superimposed layers may have the same or different geometries from each other. Such an offset arrangement can provide greater support to a user compared to other embodiments of cushions. In embodiments where the superimposed layers are made from the same material, the stiffness and/or deformability of a zone with superimposed layers may differ from (e.g., be stiffer than, be less deformable than, etc.) the stiffness and/or deformability of a zone with a single layer. Likewise, the stiffness and/or deformability of a zone with three superimposed layers may differ from the stiffness and/or deformability of a zone with two superimposed layers.

Any combination of stiffeners, wall voids, hollow column geometries, materials, layering, etc., may be used to provide a zone of a cushion with a desired stiffness and/or deformability and to provide for variability in the stiffness and/or deformability of a cushion from one zone to another and, thus, may provide virtual contouring of the cushion and its cushioning surface.

A method for designing a cushion with a plurality of interconnected walls that define hollow columns may include determining one or more cushioning characteristics (e.g., stiffness and/or deformability) for different zones of the cushion and optimizing (e.g., minimizing, etc.) each zone of the cushion to achieve the one or more cushioning characteristics. Such a method may include one or more of incorporating features into each zone of the cushion that optimize the cushioning characteristics of the cushion, using patterned gel layers with different geometries in different zones of the cushion, using different layering of patterned gel layers in different zones of the cushion, using materials with different mechanical properties (e.g., hardness, elasticity, etc.) in different zones of the cushion, etc.

Other aspects of this disclosure, as well as features and advantages of various aspects of the disclosed subject matter, should be apparent to those of ordinary skill in the art through consideration of the ensuing description, the accompanying drawings, and the appended claims.

BRIEF DESCRIPTION OF THE DRAWINGS

In the drawings:

FIG. 2 also shows an embodiment of voids in the walls that define a hollow column that may be used to provide a cushion with the same or substantially the same cushioning characteristics as the section cushion shown in FIG. 1, but with less weight and/or wall-to-wall distance or spacing (i.e., distance across each cell), height or thickness, and/or density than the section of the existing cushion shown in FIG. 1;

DETAILED DESCRIPTION

Figure 1:
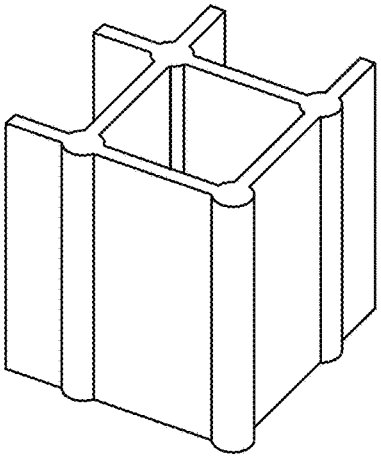
FIG. 1 is a perspective view of a section of an existing cushion.
Figure 2:
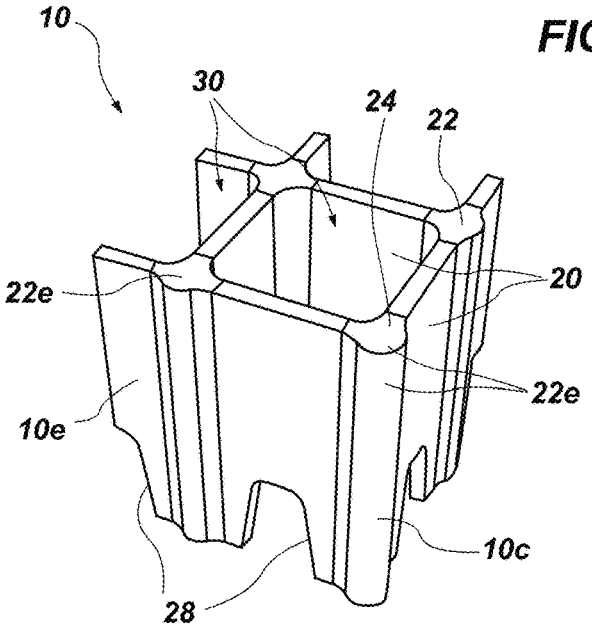
FIG. 2 is a perspective view of a section of an embodiment of a cushion that has been designed with an embodiment of stiffeners to provide the same or substantially the same cushioning characteristics as the section of the existing cushion shown in FIG. 1, but with less wall-to-wall distance or spacing (i.e., distance across each cell), height or thickness, weight, and/or density than the section of the existing cushion shown in FIG. 1.
Figure 15A:
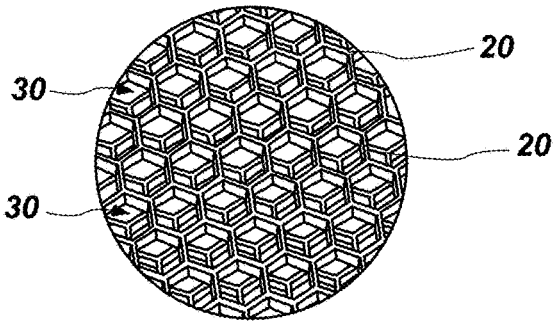
FIGS. 15A and 15B illustrate embodiments of a grid formed by a plurality of interconnected walls defining a plurality of hollow columns in cushions according to the present disclosure.
Figure 15B:
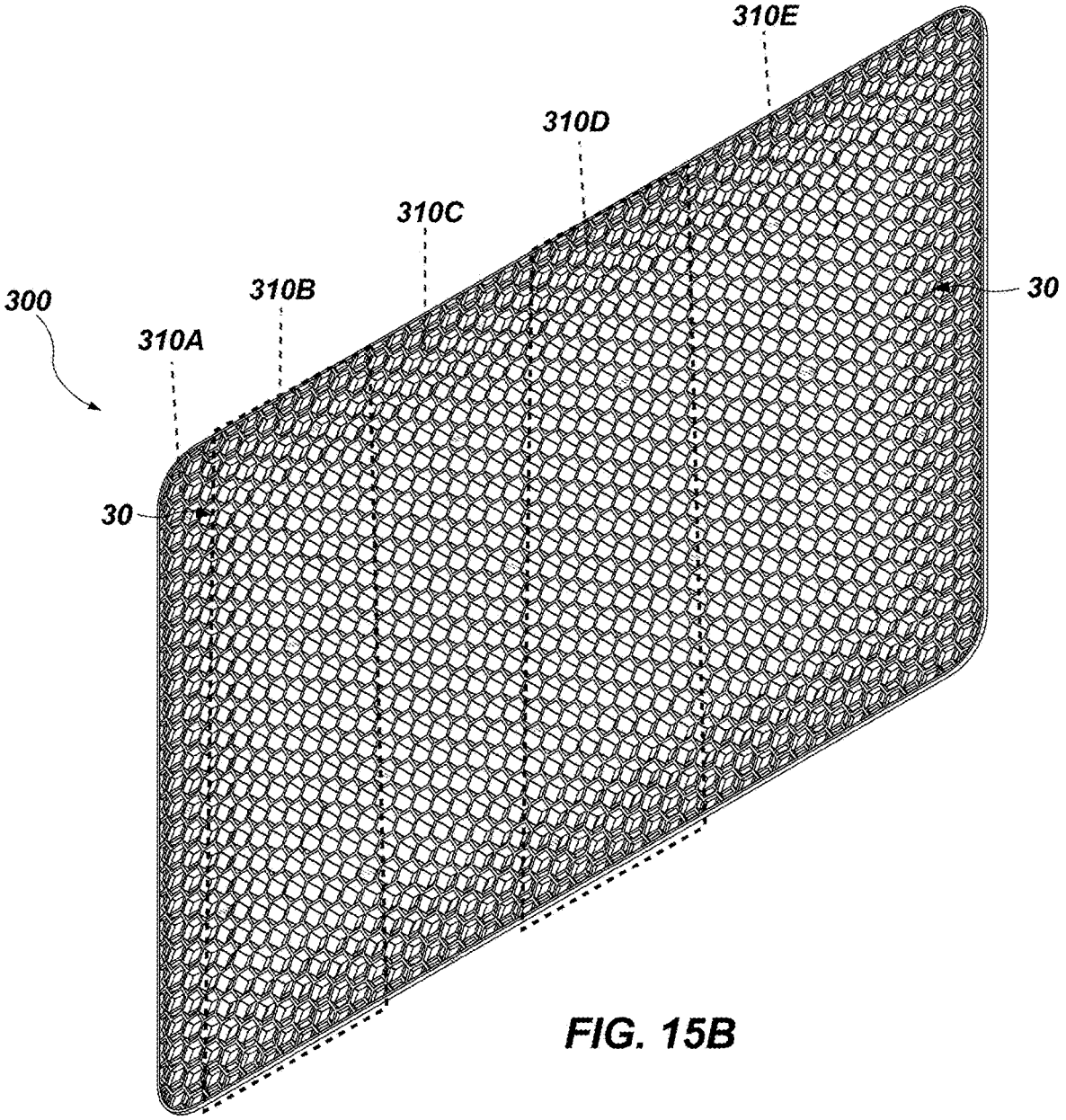

FIG. 2 illustrates an embodiment of a cushion 10 that comprises a patterned layer. The patterned layer of the cushion 10 includes and is defined by a plurality of walls 20. The walls 20 are connected to each other at junctions 22 and, thus, may be referred to as "interconnected walls." The walls 20 are arranged in such a way as to define an array of cells 32. Together, the walls 20 that define each cell 32 comprise a hollow column 30. As illustrated, the walls 20 are arranged in a grid pattern and define hollow columns 30 that have or exhibit cross sections, taken transverse to the heights of the hollow columns 30, that are substantially square in shape (e.g., with rounded corners, etc.). As illustrated in FIGS. 15A and 15B, the walls 20 can be arranged in a grid pattern and define hollow columns 30 that have or exhibit cross sections, taken transverse to the heights of the hollow columns 30, that are substantially hexagonal in shape (e.g., with rounded corners, etc.) giving rise to a "honeycomb" grid. Cushions 10 with hollow columns 30 that have other cross-sectional shapes (e.g., diamond, triangular, etc.) are also within the scope of this disclosure.

The walls 20 of the cushion 10 may be formed from any suitable material including, but not limited to, an elastomeric material. The elastomeric material may comprise a gel, which may be referred to as an "elastomeric gel" or as a "gel elastomer." Examples of elastomeric materials that comprise gels include, but are not limited to, plasticizer-extended block copolymers (e.g., plasticizer-extended diblock copolymers, plasticizer-extended triblock copolymers, etc.). U.S. Pat. Nos. 5,994,450, 6,797,765, and 7,964,664, the entire disclosures of which are hereby incorporated herein, disclose various embodiments of A-B-A triblock copolymers that may be used to form the walls 20 of the cushion 10. Purple Innovation, LLC's Hyper-Elastic Polymer 4.0 mix, which comprises a mineral oil-extended A-B-A triblock copolymer, is a specific example of a gel that may be used to define the walls 20 of the cushion 10. In embodiments where the walls 20 are formed from a gel, the cushion 10 may comprise a patterned gel layer.

When the cushion 10 is placed under a load, the hollow columns 30 may buckle, as described in U.S. Pat. Nos. 7,730,566 and 8,919,750, the entire disclosures of which are hereby incorporated herein, or bulge, as described in U.S. Patent Application Publication US 2019/0075884 A1, the entire disclosure of which are hereby incorporated herein.

As illustrated by FIG. 2, each junction 22 between interconnected walls 20 may be enlarged relative to the thicknesses of the walls 20 that define the junction 22. More specifically, such a junction 22 may define a filleted (i.e., radiused) interior corner within the interior of a hollow column 30 and, thus, comprise a "filleted junction," or stiffener. Each dimension across each end 23, 24 of such a junction 22 (e.g., in-line with the interconnected walls 20, diagonals, etc.) may exceed a thickness of each wall 22 that extends to the junction 22. Optionally, junctions 22*e* may define exterior fillets (i.e., radiused protrusions) at exterior edges 10*e* and/or corners 10*c* of the cushion 10.

Figure 2A:
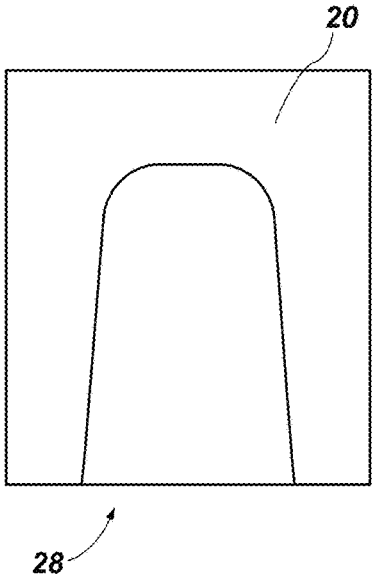
FIG. 2A is an enlarged view of an embodiment of void in a wall that defines part of a hollow column of the cushion of FIG. 2.

In addition, FIG. 2 shows an embodiment of a cushion 10 that includes voids 28 in the walls 20 that define portions of the hollow columns 30. More specifically, the voids 28 comprise recesses, or notches (e.g., trapezoidal notches, etc.), that extend upwardly from a base 26 of a wall 22, toward a top edge 27 of the wall 20. The voids 28 may extend any length upwardly on the walls 20 from the base 26 and may be positioned on each wall 20 or on selected walls 20. FIG. 2A illustrates the shape and dimensions of a specific embodiment of a void 28.

Figure 3:
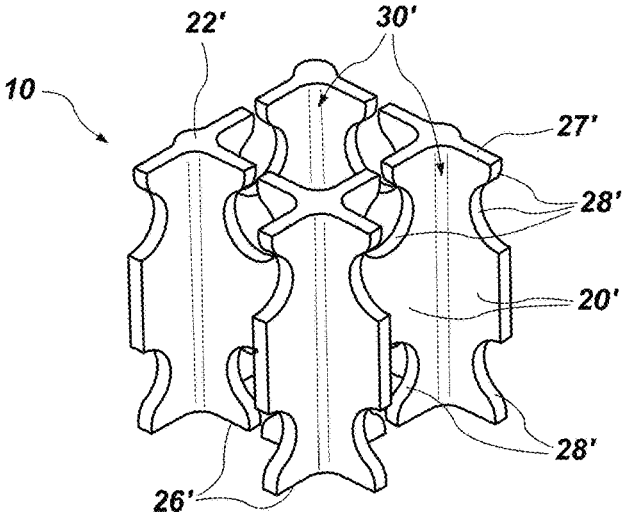
FIG. 3 is a perspective view of a section of another embodiment of a cushion that has been designed with other embodiments of voids in walls of the cushion and optional stiffeners to provide the same or substantially the same cushioning characteristics as the section cushion shown in FIG. 1, but with less weight, wall-to-wall distance or spacing (i.e., distance across each cell), height or thickness, and/or density than the section of the existing cushion shown in FIG. 1.
Figure 4:
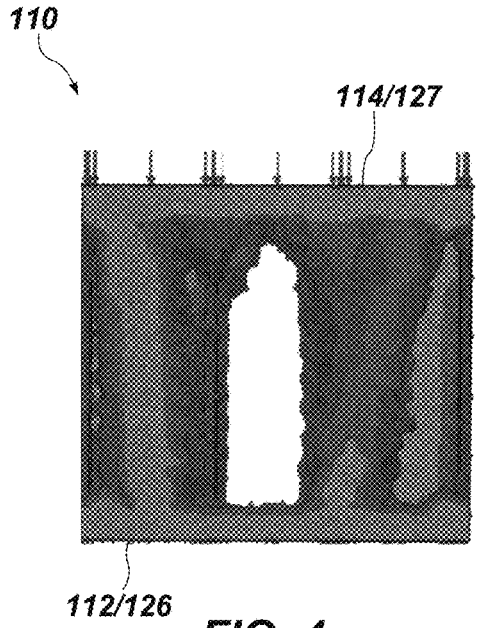
FIGS. 4-7 are respectively front, left, top, and perspective views showing the results of a topology study on a 3 column by 3 column square, 2 inch (5.1 cm) thick section of a cushion that comprises a conventionally configured patterned gel layer, showing areas of interconnected walls of the cushion that should be kept and areas of the interconnected walls that may be removed without significantly affecting cushioning characteristics of the section of the cushion.
Figure 5:
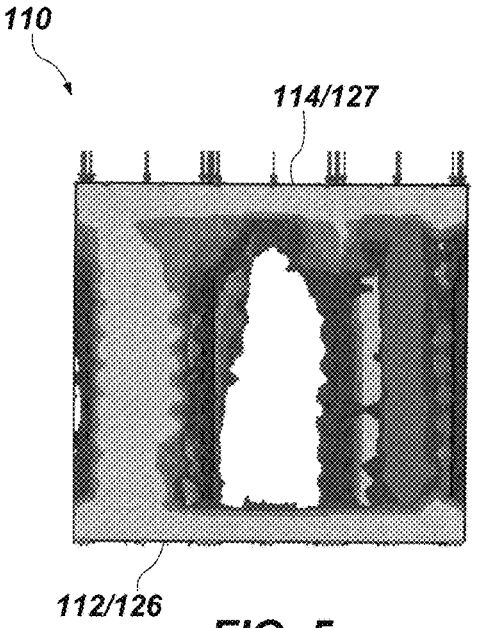
Figure 6:
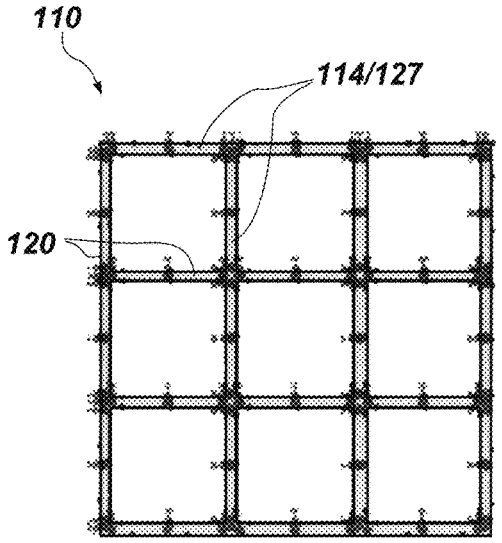
Figure 7:
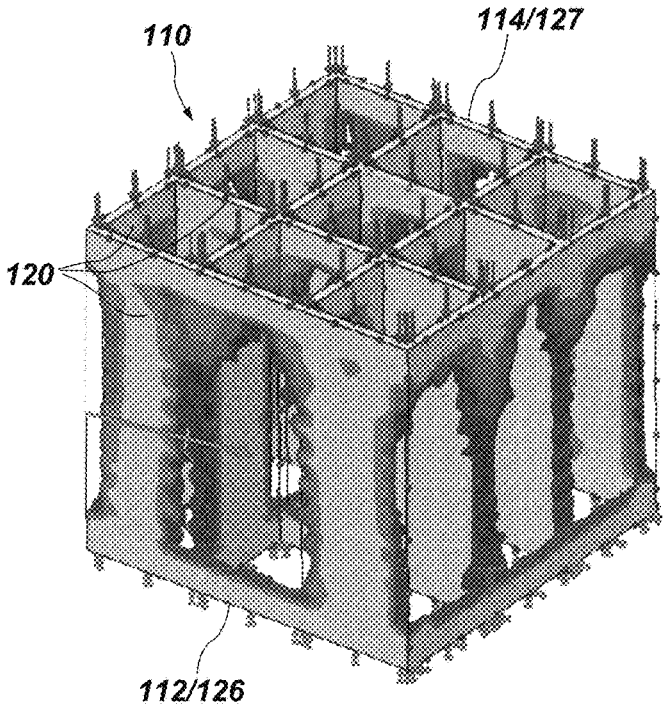

Referring now to FIG. 3, another embodiment of a cushion 10' is shown. The cushion 10' includes walls 20' that are formed from an elastomeric material, such as a gel. The walls 20' are connected at junctions 22'. The walls 20' define hollow columns 30'. Voids 28' may be defined in the walls 20' (e.g., in a plane of a wall 20', etc.). The voids 28' may comprise a recess in a base 26' of a wall 20' and/or a recess in a top edge 27' of the wall 20'. Optionally, the voids 28' may have so-called "keyhole" shapes that extend to the base 26' or the top edge 27' of the wall 20'. In addition, selected junctions 22' may be enlarged relative to the thicknesses of the walls 20' that define such junctions 22'.

Figure 14:
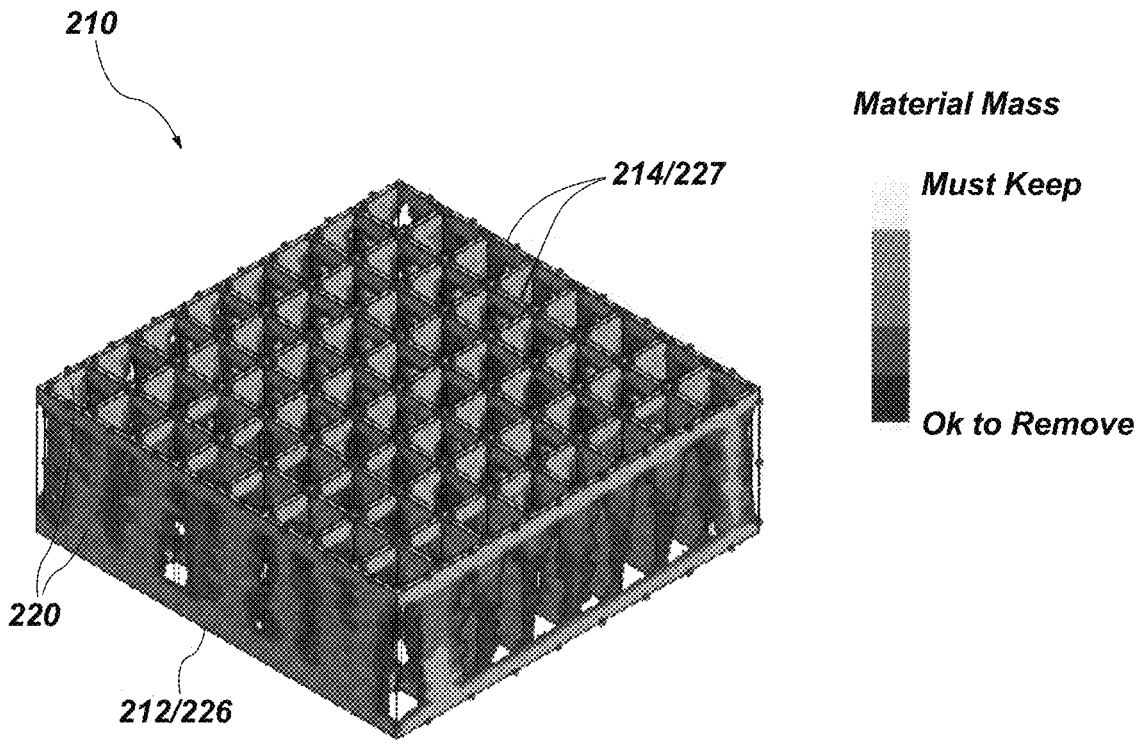
FIG. 14 is a perspective view showing the results of a topology study on an 8 column by 8 column square, 2 inch (5.1 cm) thick section of a conventionally configured cushion, showing areas of interconnected walls of the cushion that should be kept and areas of the interconnected walls that may be removed without significantly affecting cushioning characteristics of the section of the cushion.

FIGS. 4-7 and 14 depict the results of a topology study that was conducted by fixing the location of a base 112 (i.e., the bottom edges 126, 226 of the walls 120, 220) of a section of a cushion 110, 210 and applying a compressive force to a top 114 (i.e., the top edges 127, 227 of the walls 120, 220) of the section of the cushion 110, 210. The study was computer-simulated. In FIGS. 4-7, the topology study was conducted on a 3 column by 3 column square section of a 2 inch (5.1 cm) thick cushion 110. In FIG. 14, the topology study was conducted on an 8 column by 8 column square, 2 inch (5.1 cm) thick section of a cushion 210. The walls 120, 220 of each section of the cushion 110, 210 were 0.12 inch (30 mm) thick and defined hollow columns 130, 230 with substantially square cross-sections taken transverse to the lengths of the hollow columns 130, 230. Junctions 122, 222 between interconnected walls 120, 220 were cylindrical in shape with diameters of 0.26 inch (67 mm). The center of each junction 122, 222 was spaced 1.2 inches (2.9 cm) from its adjacent junctions 122, 222 along the walls 120, 220 that define the junction 122, 222. Each section of the cushion 110, 210 was made from Purple's Hyper-Elastic Polymer 4.0 mix, which comprised a mineral oil-extended A-B-A triblock copolymer.

Figure 8:
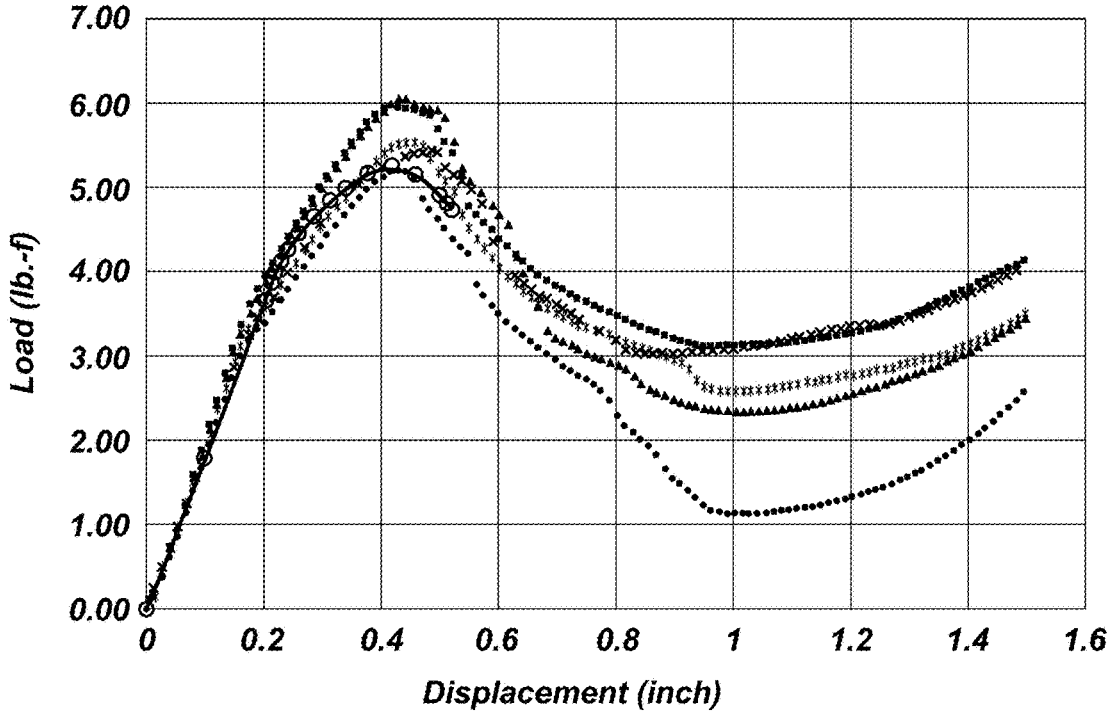
FIG. 8 is a graph providing a comparison of the displacement achieved with sections of various cushions, including experimental displacement data achieved under various loads with the section of the previously existing cushion depicted by FIG. 1, simulated with a section of the cushion of this disclosure, and achieved with a section of a previously existing mattress cushion from Purple Innovation having standard wall dimensions and spacing and a height or thickness of three inches.

FIG. 8 is a calibration plot used to calculate a mathematical model of the elastomeric material. The results of the topology studies depicted by FIGS. 4-7 revealed areas of the walls 120, 220 of the cushion that provide the cushion 110, 210 with structural integrity (areas in yellow), areas of the walls 120, 220 that appear to be unnecessary for the cushion 110, 210 to function as intended (transparent areas, appearing as holes in the walls 120, 220), and areas of the walls 110, 210 that may provide some structural integrity but not be necessary for the cushion 110, 210 to function as intended (areas in various shades of blue).

Figure 9:
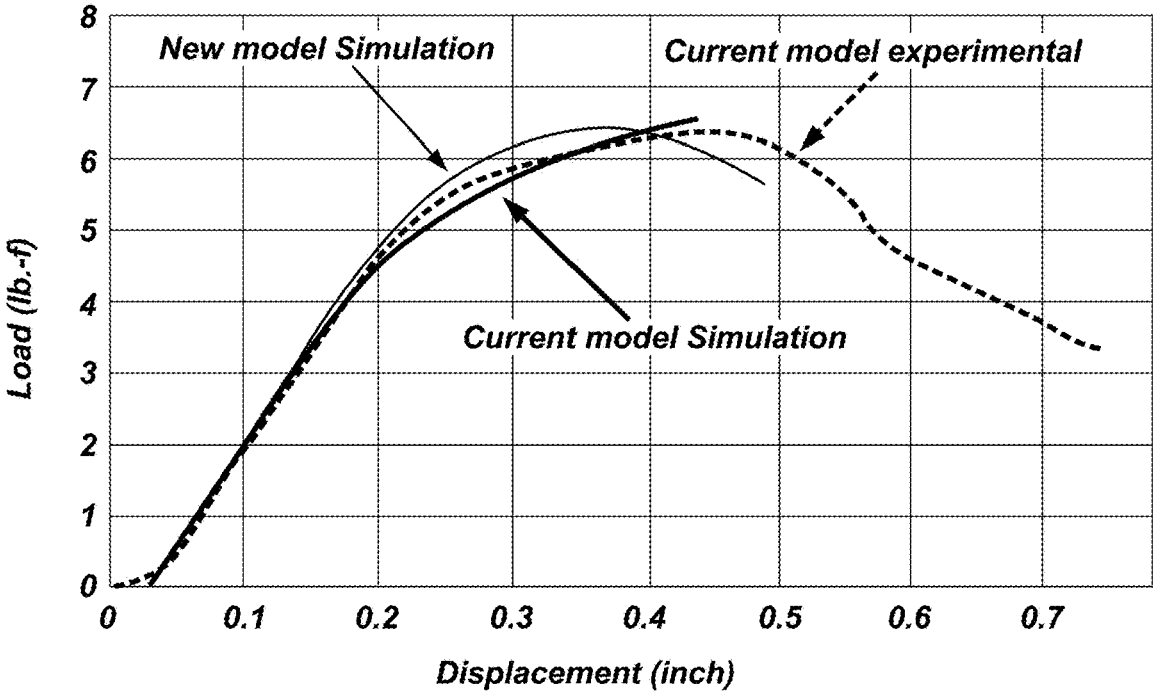
FIG. 9 is a graph comparing the cushioning characteristics of a cushion according to this disclosure to the cushioning characteristics of a thicker, heavier conventionally configured cushion.

The topology study was simulated on the embodiment of cushion 10 shown in FIGS. 2 and 2A, which has a wall-to-wall distance or spacing (i.e., distance across each cell), height or thickness of 1¾ inch (4.4 cm), hollow columns 30 with 0.10 inch (2.5 mm) radiused inner corners, and voids 28 with the dimensions shown in FIG. 2A. FIG. 9 provides a comparison of the simulated topology study to the above-described topology study (in reference to FIGS. 4-7). As illustrated by FIG. 9, a thinner, lighter weight cushion according to this disclosure may provide the same cushioning characteristics as the conventionally configured cushion.

Figure 10:
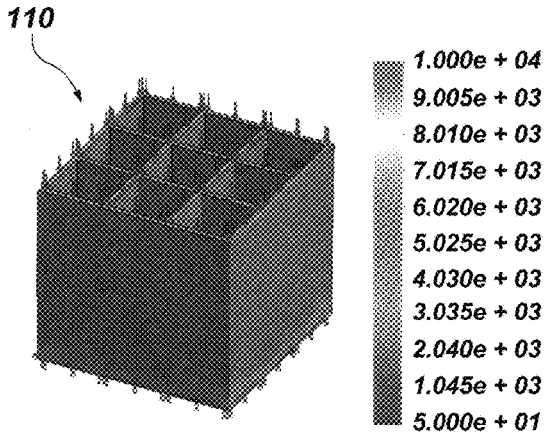
FIGS. 10 and 11 respectively show the stresses on various locations of a 3 column by 3 column square, 2 inch (5.1 cm) thick section of a conventionally configured cushion that lacks stiffeners and voids in its walls and the stresses on various locations of a thinner 3 column by 3 column square section of an embodiment of a cushion according to this disclosure (i.e., an optimized cushion)
Figure 11:
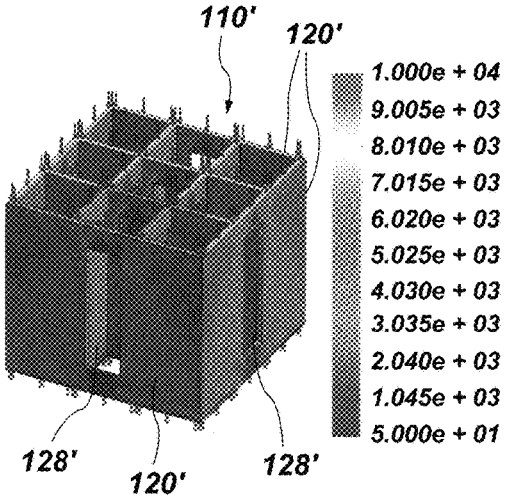

FIG. 10 shows the stress on various locations of the section of the conventionally configured cushion 110 during the topology study. FIG. 11 shows the stress the same conditions induced in various locations of a section of an embodiment of cushion 110' that includes voids 128' in selected walls 120' (i.e., the depicted windows (e.g., rectangular, etc.) in various walls 120').

Figure 12:
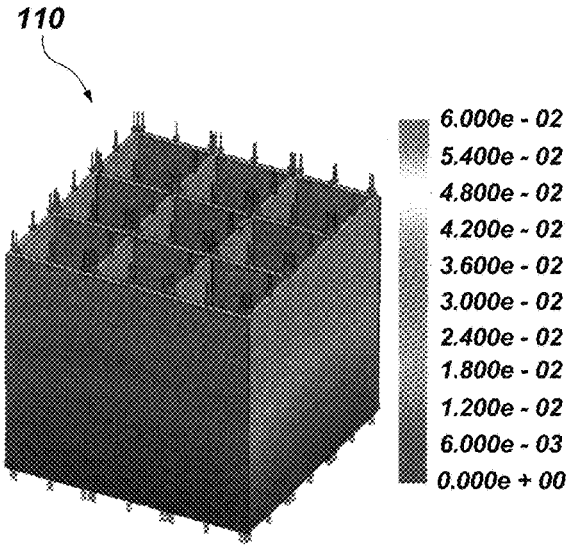
FIGS. 12 and 13 respectively show the deflection of various locations of a 3 column by 3 column square, 2 inch (5.1 cm) thick section of a conventionally configured cushion that lacks stiffeners and voids in its walls and the deflection of various locations of a thinner 3 column by 3 column square section of an embodiment of a cushion according to this disclosure (i.e., an optimized cushion)
Figure 13:
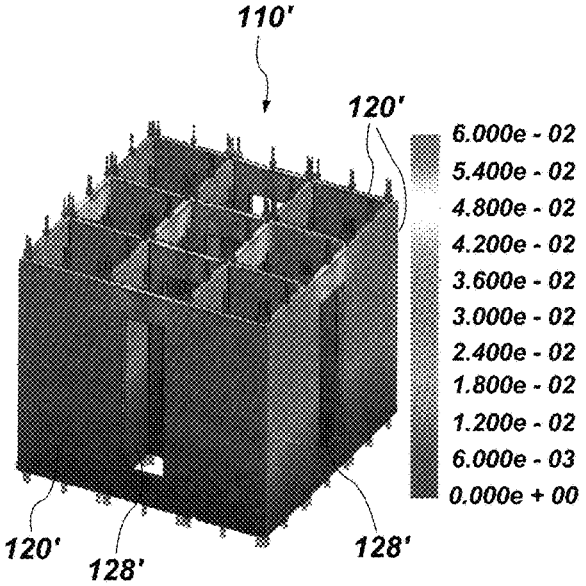

FIG. 12 shows the deflection of various locations of the section of the conventionally configured cushion 110 during the topology study. FIG. 13 shows the simulated deflection induced by the same conditions in various locations of the section of the embodiment of the cushion 110' that includes voids 128' in selected walls 120'.

The various results illustrated in FIGS. 8-13 show that inclusion of voids 28 in the walls 120', 220' of the cushions 110', 210' does not change the overall buckling or depression profiles of the cushions 110', 210'. That is, a cushion 110', 210' including walls 120', 220' with one or more voids 28 can provide the same cushioning characteristics as a conventionally configured cushion 110, 210. And, including the voids 28 in the walls 120', 220' can result in an overall lighter weight cushion 110', 210', even while maintaining a uniform wall-to-wall distance or spacing (i.e., distance across each cell), height or thickness throughout the cushion 110', 210'.

For example, with returned reference to FIG. 2, a cushion 10 constructed from an elastomeric material includes a plurality of interconnected walls 20 defining a plurality of hollow columns 30, with the walls 20 being arranged to define a grid (e.g., a square grid or a honeycomb grid). The cushion 10 can have an overall wall 20-to-wall 20 distance or spacing (i.e., distance across each hollow column 30) of about 1 inch (2.54 cm) and a height or thickness of about 2 inches (5.1 cm) to about 4 inches (10.2 cm) (e.g., 2 inches (5.1 cm), 2.5 inches (6.4 cm), about 3 inches (7.6 cm), 3.5 inches (8.9 cm), etc.). This wall 20-to-wall 20 distance or spacing (i.e., distance across each hollow column 30) can be uniform or substantially uniform from one edge of the cushion 10 to an opposite edge of the cushion 10. The height or thickness of the cushion 10 may be uniform or substantially uniform (e.g., accounting for design tolerances, rounding or tapering at the edges of the cushion 10, etc.) and, thus, the height of the hollow columns 30 of the cushion 10 or the portion thereof may be the same or substantially the same across the surface area occupied by the cushion 10 or the portion thereof. At least some walls 20 of the plurality of interconnected walls includes one or more stiffened junctions 22 (and/or voids 28 (FIG. 3) and/or other features (hollow column 30 shape, hollow column 30 size, wall 20 thickness, material, etc.)) that contribute to a cushioning characteristic of a portion of the cushion 10. For example, junctions 22 between the interconnected walls 20 at corners of the hollow columns 30 can be enlarged to impart more stiffness to a particular location or area of the cushion 10. Including more enlarged junctions 22 results in an overall stiffer location or area of the cushion 10. Including fewer enlarged junctions 22 or no enlarged junctions 22 at a particular location or area of the cushion 10 results in an overall softer or more pliant location or area of cushion 10. Thus, the enlarged junctions 22 may impart the cushion 10 with a virtual contoured effect or virtually contoured cushioning characteristic. Further, the enlarged junctions 22 may be graded in (i) size, (ii) location, and/or (iii) concentration, providing smooth virtual transitions between different areas of a virtually contoured cushion 10 that have different cushioning characteristics to impart the cushion 10 with smooth virtual transitions between the different areas.

Additionally, and/or alternatively, with returned reference to FIG. 3, at least some walls 20' (e.g., some walls 20', each wall 20', etc.) of the plurality of interconnected walls may include one or more voids 28 (e.g., windows, cut-outs, recesses, etc.) (see FIGS. 2A-7). Voids 28 may be included in walls 20' of the cushion 10' to soften the cushion 10'. Voids 28 may reduce the weight of the cushion 10' and or soften the cushion 10' or a portion thereof. The inclusion of voids 28 may not change or have an impact on the height of each wall 20' or, thus, on the height or thickness of the cushion 10'. The inclusion of voids 28 in the walls 20' may not change or have an impact on the overall wall 20'-to-wall 20' distance or spacing (i.e., distance across each hollow column 30'). Rather, the presence of the voids 28 in various walls 22', as well as the sizes, shapes, and/or number of voids 28 (each of the foregoing contributing to the concentration of voids 28), locations of voids 28 in the walls 20', or the like, may impart a location or an area of the cushion 10' with desired cushioning characteristic. By varying the manner in which voids 28 are include in walls 20' in different locations or areas of the cushion 10', the voids 28' may impart the cushion 10' with a virtual contoured effect or virtually contoured cushioning characteristic. Further, the locations of the voids 28 in the walls 20' of a cushion 10' can be graded in (i) size, (ii) location, and/or (iii) concentration to provide smooth virtual transitions between different areas of a virtually contoured cushion 10' that have different cushioning characteristics to impart the cushion 10' with smooth virtual transitions between the different areas.

In some embodiments, the virtual contouring of the cushion 10, 10' arises out of the manner in which enlarged junctions 22 (FIG. 2) are employed across the cushion 10. In other embodiments, the virtual contouring of the cushion 10, 10' arises out of the manner in which voids 28 (FIG. 3) are employed across the cushion. In still other embodiments, other features (e.g., cross-sectional shapes of hollow columns 30, 30', cross-sectional dimensions of hollow columns 30, 30', thicknesses of walls 20, 20', materials from which walls 20, 20' are formed, layering, etc.) may contribute to the virtual contouring of a cushion 10, 10'. In addition, combinations of the foregoing (e.g., enlarged junctions 22, voids 28, etc.) may be varied to impart a cushion 10, 10' that has a uniform or substantially uniform height or thickness with virtual contouring. For example, a cushion of the present disclosure having contoured cushioning characteristics can have regions with stiffer cushioning characteristics, regions with softer cushioning characteristics, and combinations thereof. The gradient of cushioning characteristics formed between the two regions can correspond to areas of the human body that would benefit from a firmer and/or softer cushioning characteristic. Specifically, regions having stiffer cushioning characteristics can correspond to the neck, shoulder, and/or hip areas of the human body. Additionally, the regions having softer cushioning characteristics can correspond to the back/or leg areas of the human body.

FIG. 15B depicts an embodiment of cushion 300 with a plurality of different zones 310A, 310B, etc. (each of which may also be referred to as a zone 300, any combination of which may be referred to as zones 300) that impart the cushion 300 with a virtual contour. Each zone 310 has a cushioning characteristic (e.g., a stiffness and/or deformability) that differs from the cushioning characteristic of each adjacent zone 310. Optionally, adjacent zones 310 may be integrally formed. Gradients may be formed from one zone 310 to an adjacent zone 310. Such a cushion 300 may comprise at least a part of a mattress, a mattress topper, a seat cushion, a pillow, or any other type of cushioning device.

Returning reference again to FIGS. 2 and 3, the contoured cushioning profile imparted to the cushion 10, 10' by the enlarged junctions 22, voids 28, and/or other features may not make the cushion 10, 10' feel thinner to a user. Rather, in some embodiments, a contoured cushioning profile can make a cushion 10, 10' feel thicker or more buoyant to a user. For example, in a cushion 10, 10' having a height or thickness of approximately 3 inches (about 7.5 cm), the user may feel as though the cushion 10, 10' has a height or thickness of approximately 4 inches (about 10 cm), due to the cushioning characteristics of the cushion 10, 10' or one or more locations or areas of the cushion 10, 10'. That is, if the cushion 10, 10' provides more support to key areas of the user's body (e.g., neck, shoulder, and/or hip areas, etc.), the user may feel as though the cushion 10, 10' is thicker or plusher. In this way, the cushion 10, 10' can have a thinner and more uniform overall profile or construction, while imparting to a user the feel of a thick and plush cushion.

In addition to imparting a cushion 10' (FIG. 3) with a "contoured" effect or contoured cushioning profile, the inclusion of voids 28 in the walls 20' of the cushion 10' results in a lighter overall cushion 10', as well as a cushion 10' that is easier to handle during manufacture, shipping, setup, and movement. Further, lighter cushions 10' require less energy to ship. Additionally, a cushion 10' with voids 28 may be easier to remove from the mold used to form the cushion 10'. That is, by being lighter and somewhat more pliable, the cushion 10' may be more easily evacuated from a mold. Reducing the weight of a cushion 10' may also reduce the time required to manufacture and ship the cushion 10'.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A cushion, comprising:

a first area comprising a first patterned gel layer including first interconnected walls formed from a first elastomeric material and defining a first plurality of hollow columns, the first area having a first stiffness and/or deformability; and a second area comprising a second patterned gel layer including second interconnected walls formed from a second elastomeric material and defining a second plurality of hollow columns, the second area having a second stiffness and/or deformability that is different than the first area, the first area including at least one first stiffener comprising a first curved junction between two of the first interconnected walls and at least one first void extending vertically from a base of at least one first wall of the first plurality of interconnected walls, wherein the at least one first stiffener and/or the at least one first void imparts the first area with the first stiffness and/or deformability, and the second area including at least one second stiffener comprising a second curved junction between two of the second interconnected walls and at least one second void extending vertically from a base of at least one second wall of the second plurality of interconnected walls, wherein the at least one second stiffener and/or the at least one second void imparts the second area with the second stiffness and/or deformability.

2. The cushion of claim 1, wherein a first number of the at least one first stiffener in a unit area of the first area exceeds a second number of the at least one second stiffener in a unit area of the second area.

3. The cushion of claim 1, wherein the at least one first stiffener is larger than the at least one second stiffener.

4. The cushion of claim 1, wherein a first number of the at least one first void in a unit area of the first area exceeds a second number of the at least one second void in a unit area of the second area.

5. The cushion of claim 1, wherein the at least one first void is smaller than the at least one second void.

6. The cushion of claim 1, wherein the second area lacks stiffeners and/or voids in at least one of the second walls.

7. The cushion of claim 1, wherein the first elastomeric material and the second elastomeric material are the same elastomeric material.

8. The cushion of claim 1, wherein at least one of a first number of the first patterned gel layer, the first elastomeric material, and a geometry of the first patterned gel layer differs from the second number of the second patterned gel layer, the second elastomeric material, and the geometry of the second patterned gel layer.

9. The cushion of claim 1, further comprising:

a gradient between the first area and the second area, the gradient defined by at least one of stiffeners and/or voids in walls of adjacent portions of the first area and the second area.

10. The cushion of claim 1, wherein the first area and the second area are integrally formed.

11. A method for manufacturing a cushion, comprising:

forming a first zone to include a first patterned gel layer with first interconnected walls defining first buckling columns, the first zone including at least one first stiffener comprising a first curved junction between two of the first interconnected walls and at least one first void extending vertically from a base of at least one first wall of the first interconnected walls, wherein the at least one first stiffener and/or the at least one first void imparts the first zone with a first cushioning characteristic; and forming a second zone to include a second patterned gel layer with second interconnected walls defining second buckling columns, the second zone including at least one second stiffener comprising a second curved junction between two of the second interconnected walls and at least one second void extending vertically from a base of at least one second wall of the second interconnected walls, wherein the at least one second stiffener and/or the at least one second void imparts the second zone with a second cushioning characteristic that differs from the first cushioning characteristic, and wherein the second zone is formed concurrently and integrally with the first zone.

12. The method of claim 11, wherein at least one of a first size of the at least one first stiffener and a first number of the at least one first stiffener per unit area of the first zone differs from a second size of the at least one second stiffener and a second number of the at least one second stiffener per unit area of the second zone.

13. The method of claim 11, wherein at least one of a first size of the at least one first void and a first number of the at least one first void per unit area of the first zone differs from a second size of the at least one second void and a second number of the at least one second void per unit area of the second zone.

14. The method of claim 11, wherein forming the first zone comprises forming the first patterned gel layer to have a first geometry and forming the second zone comprises forming the second patterned gel layer to have a second geometry, the first geometry differing from the second geometry.

15. The method of claim 11, wherein forming the first zone comprises forming the first zone from a first elastomeric material and forming the second zone comprises forming the second zone from a second elastomeric material, the first elastomeric material differing from the second elastomeric material.

16. The method of claim 11, further comprising:

defining a gradient from the first cushioning characteristic of the first zone to the second cushioning characteristic of the second zone.

* * * * *